US011920851B2

(12) United States Patent
Pilarski

(10) Patent No.: US 11,920,851 B2
(45) Date of Patent: Mar. 5, 2024

(54) REFRIGERATOR APPLIANCE

(71) Applicant: WHIRLPOOL CORPORATION, Benton Harbor, MI (US)

(72) Inventor: Waldemar Pilarski, Wroclaw (PL)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/748,754

(22) Filed: May 19, 2022

(65) Prior Publication Data

US 2023/0375249 A1 Nov. 23, 2023

(51) Int. Cl.
*F25D 17/04* (2006.01)
*F25D 23/02* (2006.01)

(52) U.S. Cl.
CPC ..... *F25D 17/047* (2013.01); *F25D 17/045* (2013.01); *F25D 23/028* (2013.01); *F25D 2317/0663* (2013.01)

(58) Field of Classification Search
CPC .... F25D 17/047; F25D 17/045; F25D 23/028; F25D 2317/0663
See application file for complete search history.

(56) References Cited

U.S. PATENT DOCUMENTS

| | | | | |
|---|---|---|---|---|
| 5,836,170 | A | 11/1998 | Perkins et al. | |
| 2009/0199588 | A1 | 8/2009 | Laible | |
| 2012/0180514 | A1* | 1/2012 | Lee et al. | F25D 17/047 62/285 |
| 2019/0078827 | A1* | 3/2019 | Hiller et al. | F25D 17/047 |

FOREIGN PATENT DOCUMENTS

| | | | | |
|---|---|---|---|---|
| CH | 660778 A5 * | 6/1987 | | F25D 17/047 |
| CN | 203478783 U | 3/2014 | | |
| CN | 111811181 A | 10/2020 | | |
| JP | 6747718 B2 * | 8/2020 | | F25D 17/045 |

OTHER PUBLICATIONS

CH 660778 A5 Translation (Year: 1987).*
JP 6747718 B2 Translation (Year: 2020).*

* cited by examiner

*Primary Examiner* — Elizabeth J Martin
*Assistant Examiner* — Dario Antonio Deleon
(74) *Attorney, Agent, or Firm* — Brooks Kushman P.C.

(57) ABSTRACT

A refrigerator includes a cabinet, a first door, a second door, a partition wall, and a pressure relief valve. The cabinet defines first and second internal storage chambers. The first and second doors are disposed over the first and second internal storage chambers, respectively. The first and second doors are configured to transition between open and closed positions to provide access to and cover the first and second internal storage chambers, respectively. The partition wall separates the first internal storage chamber from the second internal storage chamber. The partition wall defines a channel that establishes fluid communication between the first and second internal storage chambers. The pressure relief valve extends between the first internal storage chamber and an exterior of the cabinet. The pressure relief valve is configured to open to vent air from the first internal storage chamber to the exterior of the cabinet.

20 Claims, 3 Drawing Sheets

REFRIGERATOR APPLIANCE

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator includes a cabinet, a first door, a second door, a divider wall, and a pressure relief valve. The cabinet defines first and second internal cavities. The cabinet also defines first and second openings. The first and second openings provide access to the first and second internal cavities, respectively. The first and second doors are disposed over the first and second openings, respectively. The first and second doors are configured to transition between open and closed positions to provide access to and cover the first and second openings, respectively. The divider wall is disposed within the cabinet, separates the first internal cavity from the second internal cavity, and defines a channel that establishes fluid communication between the first and second internal cavities. The pressure relief valve is secured to an external wall of the cabinet. The pressure relief valve extends between the first internal cavity and an exterior of the cabinet. The pressure relief valve is configured to automatically open to vent air from the first internal cavity to the exterior of the cabinet in response to air flowing from the second internal cavity to the first internal cavity via the channel while the first door is in the closed position.

A refrigerator includes a housing, a plurality of doors, an internal wall, and a pressure relief valve. The housing defines a plurality of internal storage chambers and access openings. Each access opening provides access to one of the internal storage chambers. Each door is disposed over one of the access openings. Each door is configured to transition between open and closed positions to respectively provide access to and cover one of the openings. The internal wall is disposed within the housing, separates a first of the internal storage chambers from a second of the internal storage chambers, and defines a channel that establishes fluid communication between the first and second of the internal storage chambers. The pressure relief valve is secured to the housing. The pressure relief valve extends between the first of the internal storage chambers and an exterior of the cabinet. The pressure relief valve is configured to automatically open to vent air from the first of the internal storage chambers to the exterior of the cabinet in response to air flowing from the second of the internal storage chambers to the first of the internal storage chambers via the channel.

A refrigerator includes a cabinet, a first door, a second door, a partition wall, and a pressure relief valve. The cabinet defines first and second internal storage chambers. The first and second doors are disposed over the first and second internal storage chambers, respectively. The first and second doors are configured to transition between open and closed positions to provide access to and cover the first and second internal storage chambers, respectively. The partition wall separates the first internal storage chamber from the second internal storage chamber. The partition wall defines a channel that establishes fluid communication between the first and second internal storage chambers. The pressure relief valve extends between the first internal storage chamber and an exterior of the cabinet. The pressure relief valve is configured to open to vent air from the first internal storage chamber to the exterior of the cabinet in response to air flowing from the second internal storage chamber to the first internal storage chamber via the channel as a result of transitioning the second door to the closed position.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
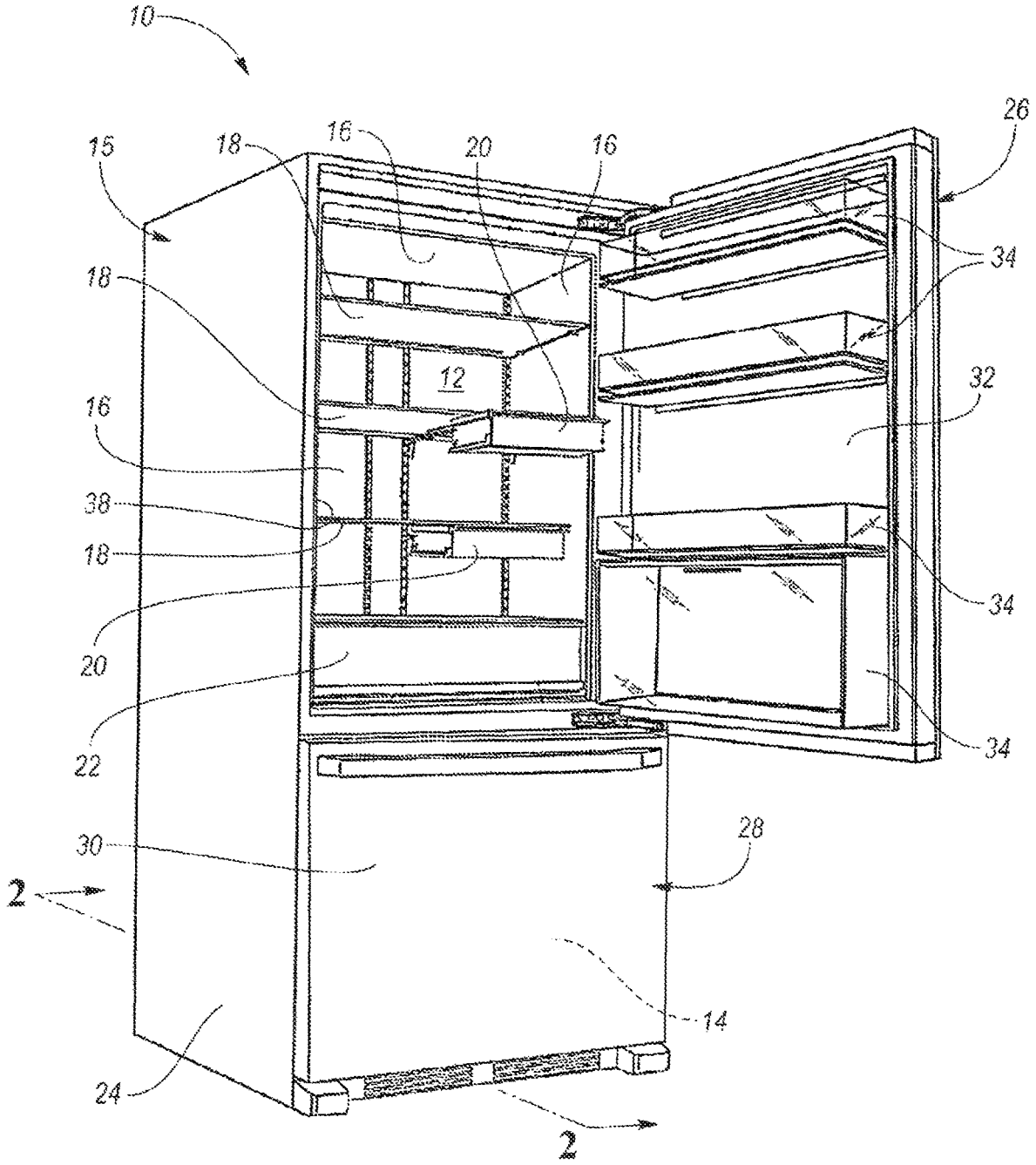
FIG. 1 is an isometric front view of a bottom-mount type refrigerator appliance with the refrigeration compartment door open.

Referring to FIG. 1, generally a refrigerator 10 of the two-door bottom mount type is illustrated. However, it should be understood that this disclosure could apply to any type of refrigerator, such as a side-by-side, French-Door Bottom Mount, or a top-mount type. As shown in FIG. 1, the refrigerator 10 may have a first internal cavity, first internal storage chamber, or fresh food compartment 12 configured to refrigerate and not freeze consumables within the fresh food compartment 12, and a second internal cavity, second internal storage chamber, or a freezer compartment 14 configured to freeze consumables within the freezer compartment 14 during normal use. The fresh food compartment 12 and freezer compartment 14 may be defined by a housing or cabinet 15 of the refrigerator 10. It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The refrigerator 10 includes one or more refrigeration loops (not shown) that are configured to cool the air the within the fresh food compartment 12 and the freezer compartment 14. The refrigeration loop includes at least a compressor, an evaporator that cools air being delivered to the fresh food compartment 12 and/or the freezer compartment 14, a condenser that rejects heat to ambient surroundings, and a thermal expansion valve. Fans may be utilized to direct air across the evaporator and the condenser to facilitate exchanging heat. The compressor and the fans may be connected to a controller. Sensors that measure the air temperature within the fresh food compartment 12 and the freezer compartment 14 may be in communication with the controller. The controller may be configured to operate the compressor, fans, etc. in response to the air temperature within the within the fresh food compartment 12 and the freezer compartment 14 being less than a threshold.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

The refrigerator 10, or more specifically the cabinet 15, includes panels or internal walls 16 that define the fresh food compartment 12 and the freezer compartment 14. The walls 16 may more specifically form an internal liner of the refrigerator 10. The walls 16 may include a rear or back wall, a top wall, a bottom wall, internal divider walls, and two opposing side walls. One or more shelves 18 may be secured to the walls 16 within the fresh food compartment 12. One or more drawers 20 may be slidably secured to the shelves 18 or the walls 16 within the fresh food compartment 12. One or more crisper drawers 22 may be slidably secured to the shelves 18 or the walls 16 within the fresh food compartment 12. The crisper drawer 22 may more specifically be a drawer defining a storage space that is kept at a desired humidity that may be different from the remainder of the fresh food compartment 12, but that is optimal for maintaining freshness of fruits and vegetables.

The refrigerator 10, or more specifically the cabinet 15, includes an outer shell, frame, or housing that comprises several exterior panels or walls 24. The outer shell, frame, or housing that comprises several exterior panels or walls 24 may also be referred to as the refrigerator cabinet wrapper. The exterior walls 24 may include a rear or back wall, a top wall, a bottom wall, and two side walls. An insulating material, such as an insulating foam, may be disposed between each exterior wall 24 and an adjacent corresponding interior wall 16 in order reduce the heat transfer from the ambient surroundings to the fresh food compartment 12 and the freezer compartment 14, which increases the efficiency of the refrigerator 10. Each exterior wall 24, adjacent corresponding interior wall 16, and the insulating material disposed between each exterior wall 24 and adjacent corresponding interior wall 16 may collectively be referred to as a single wall of the cabinet of the refrigerator.

The refrigerator 10 may have one or more doors 26, 28 that provide selective access to the interior volume of the refrigerator 10 where consumables may be stored. As shown, the fresh food compartment door is designated 26, and the freezer door is designated 28. The doors 26, 28 may be rotatably secured to the frame or housing of the refrigerator 10 by one or more hinges. Alternatively, one or more of the doors 26, 28 may be configured to slide into and out of the cabinet 15.

The doors 26, 28 may each include an exterior panel 30 and an interior panel 32 that is disposed on an internal side of the respective exterior panel 30 of each door 26, 28. The interior panels 32 may be configured to face the fresh food compartment 12 and freezer compartment 14 when the doors 26, 28 are in closed positions. The interior panels 32 may more specifically be door liners. An insulating material, such as an insulating foam, may be disposed between the exterior panels 30 and an adjacent corresponding interior panel 32 of each door 26, 28 in order reduce the heat transfer from the ambient surroundings and increase the efficiency of the refrigerator 10.

The doors 26, 28 may also include storage bins 34 that are able to hold food items or containers. The storage bins 34 may be secured to the interior panels 32 of each door 26, 28. Alternatively, the storage bins 34 may be integrally formed within or defined by the interior panels 32 of each door 26. 28. In yet another alternative, a portion of the storage bins 34 may be secured to the interior panels 32 the doors 26, 28, while another portion of the storage bins 34 may be integrally formed within or defined by the interior panels 32 the doors 26, 28. The storage bins 34 may include shelves (e.g., a lower surface upon, which a food item or container may rest upon) that extend from back and/or side surfaces of the interior panels 32 of the doors 26, 28.

Figure 2:
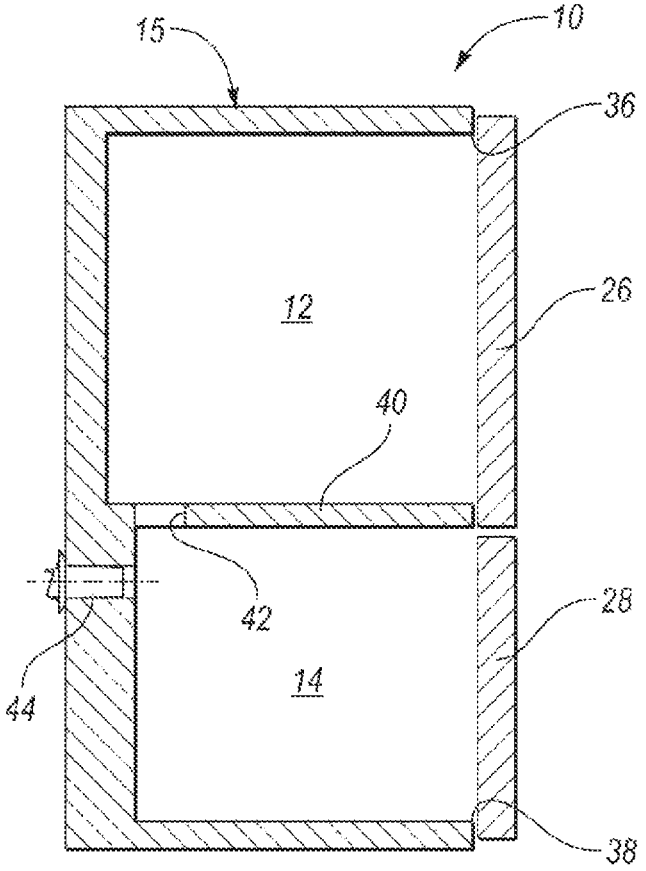
FIG. 2 is a cross-sectional view of a cabinet and doors of the refrigerator appliance taken along line 2-2 in FIG. 1.

Referring to FIG. 2, a cross-sectional view of the cabinet 15 and doors 26, 28 taken along line 2-2 in FIG. 1 is illustrated. In order to simplify the image in FIG. 2, the walls of cabinet 15 are illustrated as single solid components (i.e., the internal walls 16 and the exterior walls 24 having an insulating material disposed therebetween are shown as a single solid components in FIG. 2). Also, in order to further simply the image of FIG. 2, the doors 26, 28 are illustrated as single solid components (i.e., the exterior panels 30 and the interior panel 32 having an insulating material disposed therebetween are shown as a single solid components in FIG. 2).

The cabinet 15 defines a first access opening 36 that provides access to the fresh food compartment 12 and a second access opening 38 that provides access to the freezer compartment 14. Door 26 is disposed over the first opening 36 and the fresh food compartment 12. Door 26 is configured to transition to an open position (e.g., door 26 in FIG. 1) to provide access to the first opening 36 and the fresh food compartment 12. Door 26 is configured to transition to a closed position (e.g., door 26 in FIG. 2 and door 28 in FIGS. 1 and 2) to cover the first opening 36 and the fresh food compartment 12. Door 28 is disposed over the second opening 38 and the freezer compartment 14. Door 28 is configured to transition to an open position to provide access to the second opening 38 and the freezer compartment 14. Door 28 is configured to transition to a closed position to cover the second opening 38 and the freezer compartment 14.

An internal wall, divider wall, or partition wall 40 is disposed within the cabinet 15. The partition wall 40 may form a portion of the cabinet 15. The partition wall 40 separates or divides the fresh food compartment 12 from the freezer compartment 14. The partition wall 40 defines a channel 42 that establishes fluid communication between the fresh food compartment 12 and the freezer compartment 14. Closing one of the doors 26, 28 with excessive force may result in a bumping effect causing the other of the doors 26, 28 to slightly open. The slightly opened door may or may not then return to the closed position. Such a bumping effect may not be desirable, particularly if the door that was bumped open does not fully return to the closed position where a seal is created between the door and the cabinet 15.

The bumping effect is caused by an increase in pressure within the cabinet 15, which is the result of closing one of the doors with excessive force. For example, closing door 26 with excessive force increases the pressure within the fresh food compartment 12, which in turn increases the pressure within the freezer compartment 14 causing door 28 to slightly open. In this example, the increase in pressure is transferred from the fresh food compartment 12 to the freezer compartment 14 via the fluid communication between the two compartments that is established by channel 42. Fluid (e.g., air) may flow from the fresh food compartment 12 to the freezer compartment 14 via channel 42, increasing the pressure in the freezer compartment 14, in response to the pressure increase in the fresh food compartment 12 caused by closing door 26 with excessive force.

As another example, closing door 28 with excessive force increases the pressure within the freezer compartment 14, which in turn increases the pressure within the fresh food compartment 12 causing door 26 to slightly open. In this example, the increase in pressure is transferred from the freezer compartment 14 to the fresh food compartment 12 via the fluid communication between the two compartments that is established by channel 42. Fluid (e.g., air) may flow from the freezer compartment 14 to the fresh food compartment 12 via channel 42, increasing the pressure in the fresh food compartment 12, in response to the pressure increase in the freezer compartment 14 caused by closing door 28 with excessive force.

In order to illuminate such a bumping effect, a pressure release or pressure relief valve 44 is secured to the cabinet 15. More specifically, the pressure relief valve 44 is secured to and extends through one of the walls of the cabinet 15. The pressure relief valve 44 extends between the freezer compartment 14 and the space around the exterior of the cabinet 15. The pressure relief valve 44 is configured to automatically open to vent air from the freezer compartment 14 to the space around the exterior of the cabinet 15 in response to air flowing from the fresh food compartment 12 to the freezer compartment 14 via the channel 42 and/or in response to the pressure within the freezer compartment 14 exceeding a threshold. The flow of air from the fresh food compartment 12 to the freezer compartment 14 via the channel 42 and/or the pressure within the freezer compartment 14 exceeding the threshold may be the result of door 26 transitioning from the open position to the closed position. The pressure relief valve 44 may be configured to transition to the open position in response to the pressure increase in the freezer compartment 14 only if door 28 is in the closed position. If door 28 is in an open position a pressure relief path is created through opening 38, which may prevent the spike in pressure within the freezer compartment 14 required to cause the pressure relief valve 44 to open.

The pressure relief valve 44 may also be configured to remain closed in response to the pressure within the freezer compartment 14 being less than the threshold, even if air is flowing from the fresh food compartment 12 to the freezer compartment 14 via the channel 42, which causes a pressure increase in the freezer compartment 14. The threshold may correspond to a lower pressure limit necessary to cause a bumping effect on door 28. Therefore, it may not be necessary to open the pressure relief valve 44 if there is an increase in pressure as long the pressure remains below the threshold. The pressure relief valve 44 then may be calibrated to only open if the pressure within the freezer compartment 14 is equal to, greater than, or within a tolerable value below the threshold.

In an alternative embodiment, the pressure relief valve 44 may extend between the fresh food compartment 12 and the space around the exterior of the cabinet 15. The pressure relief valve 44 in such an alternative embodiment is configured to automatically open to vent air from the fresh food compartment 12 to the space around the exterior of the cabinet 15 in response to air flowing from the freezer compartment 14 to the fresh food compartment 12 via the channel 42 and/or in response to the pressure within the fresh food compartment 12 exceeding a threshold. The flow of air from the freezer compartment 14 to the fresh food compartment 12 via the channel 42 and/or the pressure within the fresh food compartment 12 exceeding the threshold may be the result of door 28 transitioning from the open position to the closed position. The pressure relief valve 44 may be configured to transition to the open position in response to the pressure increase in the fresh food compartment 12 only if door 26 is in the closed position. If door 26 is in an open position a pressure relief path is created through opening 36, which may prevent the spike in pressure within the fresh food compartment 12 required to cause the pressure relief valve 44 to open.

In this alternative embodiment, the pressure relief valve 44 may also be configured to remain closed in response to the pressure within the fresh food compartment 12 being less than the threshold, even if air is flowing from the freezer compartment 14 to the fresh food compartment 12 via the channel 42, which causes a pressure increase in the fresh food compartment 12. The threshold may correspond to a lower pressure limit necessary to cause a bumping effect on door 26. Therefore, it may not be necessary to open the pressure relief valve 44 if there is an increase in pressure as long the pressure remains below the threshold. The pressure relief valve 44 then may be calibrated to only open if the pressure within the fresh food compartment 12 is equal to, greater than, or within a tolerable value below the threshold.

Figure 3:
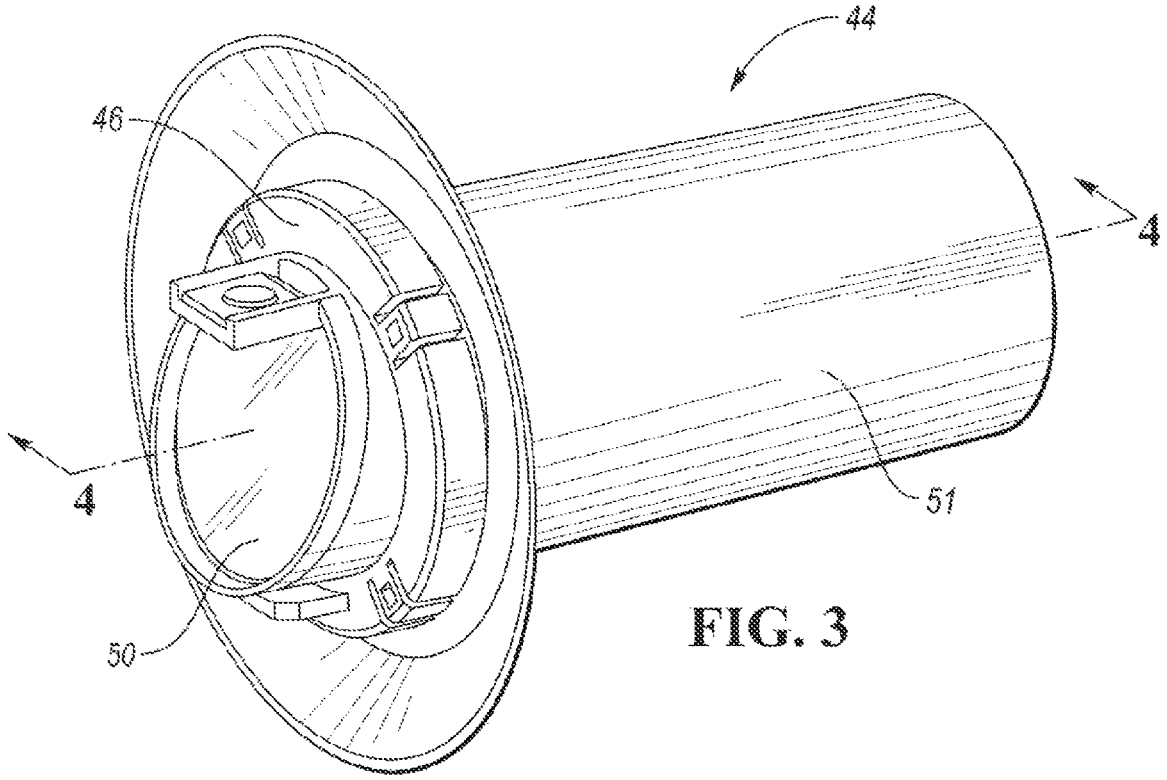
FIG. 3 is an isometric view of a pressure relief valve.
Figure 4:
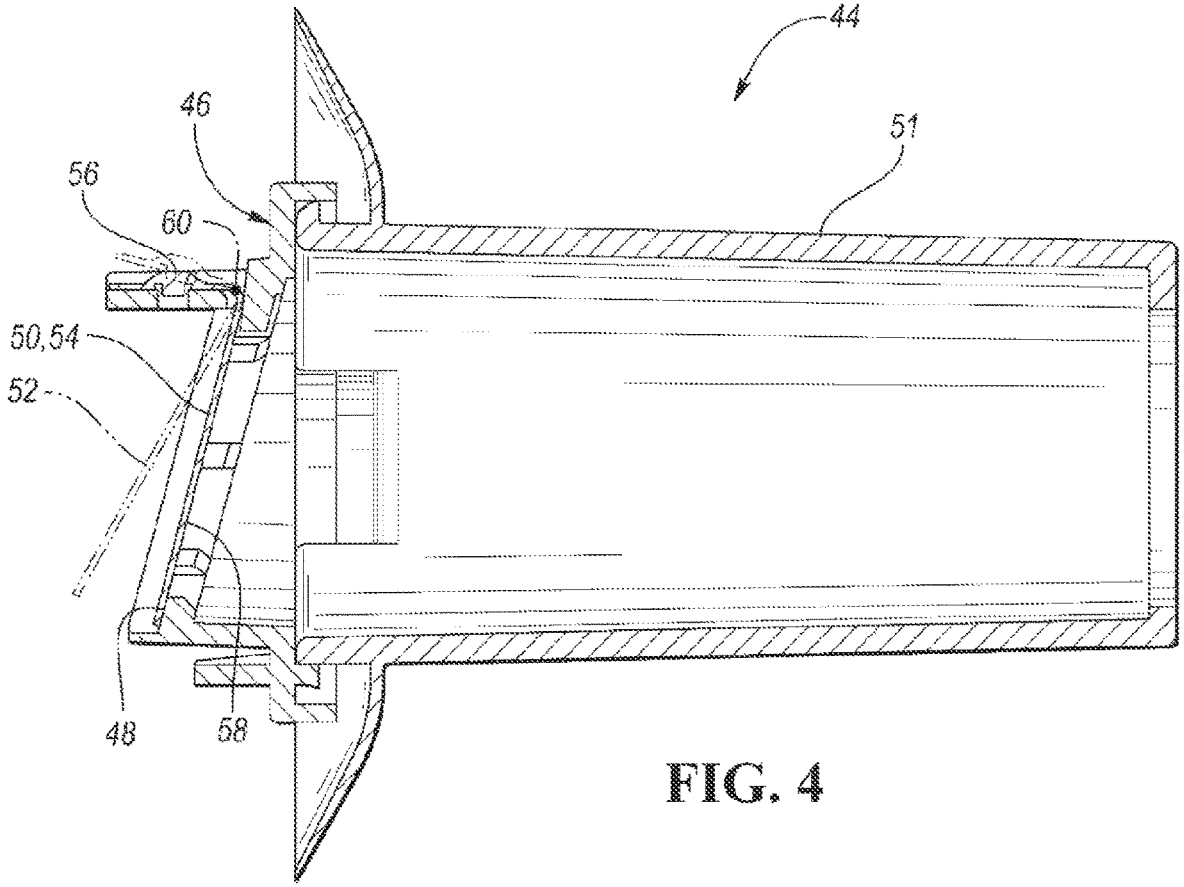
FIG. 4 is a cross-sectional view taken along line 4-4 in FIG. 3.

Referring to FIGS. 3 and 4, the pressure relief valve 44 is illustrated in further detail. The pressure relief valve 44 may be a one-way valve that allows air to flow from the interior of the cabinet 15 (e.g., the fresh food compartment 12 or the freezer compartment 14) to the exterior of the cabinet 15 but does not allow air to flow from the exterior of the cabinet 15 to the interior of the cabinet 15. The pressure relief valve 44 may include a main body 46 the defines a valve seat 48 and a valve flap or plate 50 that is configured to engage the valve seat 48 to create a seal so that air does not flow through the pressure relief valve 44. A gasket, such as a soft rubber or plastic seal, may be disposed about the valve seat 48. Such a gasket may be configured to engage the valve plate 50 to create a seal when the valve plate 50 is in a closed position. The main body 46 may be secured to a tube or conduit portion 51 that establishes fluid communication with the interior of the cabinet 15 (e.g., the fresh food compartment 12 or the freezer compartment 14).

The valve plate 50 is configured to transition to a first or open position 52 where the valve plate 50 is disengaged from the valve seat 48 so that air may flow through the pressure relief valve 44 and so that air may vent from the interior of the cabinet 15 to the exterior of the cabinet 15. The valve plate 50 is also configured to transition to a second or closed position 54 where the valve plate 50 engages the valve seat 48 creating a seal so that air is restricted or prevented from flowing between the exterior of the cabinet 15 and the interior of the cabinet 15.

A counterweight 56 may be secured to a top end of the valve plate 50. The counterweight 56 is configured to bias the valve plate into the closed position 54. The counterweight 56 may have a specified mass and may be positioned so that the leverages on the valve plate 50 are such that the valve plate 50 remains in and is biased toward the closed position 54 in response to a pressure within the interior of the cabinet 15 (e.g., the fresh food compartment 12 or the freezer compartment 14) being less than the threshold and such that the valve 50 plate transitions to the open position 52 in response to a pressure within the interior of the cabinet 15 that is greater than the threshold. For example, while in a resting position that may correspond to the closed position 54 of the valve plate 50, the force due to the air pressure acting on a backside 58 of the valve plate 50 (e.g., the pressure within the interior of the cabinet 15) must be greater than or equal to the force required to the lift the counterweight 56 in order for the valve plate 50 to transition from the closed position 54 to the open position 52 (e.g., the force due to the air pressure acting on the backside 58 of the valve plate 50 must overcome the force of gravity acting on the counterweight 56). The force due to the air pressure acting on the backside 58 of the valve plate 50 required to lift the counterweight 56 may be different than the force of gravity acting on the counterweight 56 to account for differing distances or lever lengths of the acting forces (i.e., the force due to the air pressure acting on the backside 58 of the valve plate 50 and the force of gravity acting on the counterweight 56) to a pivot point 60 of the valve plate 50.

Alternatively, as opposed to the configuration that uses the counterweight 56, the pressure relief valve 44 may include a biasing element, such as spring, that is configured bias the valve plate 50 toward the closed position 54. Such a biasing element may be pre-loaded such that the valve plate 50 remains in and is biased toward the closed position 54 in response to the pressure within the interior of the cabinet 15 (e.g., the fresh food compartment 12 or the freezer compartment 14) being less than the threshold. For example, while in a resting position that may correspond to the closed position 54 of the valve plate 50, the biasing element may be under compression force at a specificized load (e.g., a force value) such that the specified load or a higher load has to be applied to the biasing element in order for the valve plate 50 to transition from the closed position 54 to the open position 52. The specified load may be set to correspond with the threshold pressure required to open the pressure relief valve 44 (e.g., a pressure acting on the backside 58 of the valve plate 50 that is equal to the threshold pressure will apply a force equal to the specified load). More specifically, the biasing element is pre-loaded such that the valve plate 50 transitions from the closed position 54 to the open position 52 in response to the pressure within the interior of the cabinet 15 (e.g., the fresh food compartment 12 or the freezer compartment 14) exceeding the threshold.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated.

While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator comprising:

a cabinet defining (i) first and second internal cavities and (ii) first and second openings, wherein the first and second openings provide access to the first and second internal cavities, respectively;

first and second doors (i) disposed over the first and second openings, respectively, and (ii) configured to transition between open and closed positions to provide access to and cover the first and second openings, respectively;

a divider wall (i) disposed within the cabinet, (ii) separating the first internal cavity from the second internal cavity, and (iii) defining a channel that establishes fluid communication between the first and second internal cavities; and a pressure relief valve (i) secured to a wall of the cabinet, (ii) extending between the first internal cavity and an exterior of the cabinet, (iii) configured to automatically open to vent air from the first internal cavity to the exterior of the cabinet in response to air flowing from the second internal cavity to the first internal cavity via the channel while the first door is in the closed position, and (iv) configured to remain closed in response to air flowing from the second internal cavity to the first internal cavity via the channel while the first door is in the open position.

2. The refrigerator of claim 1, wherein the pressure relief valve is configured to (i) open in response to a pressure within the first internal cavity exceeding a threshold due to air flowing from the second internal cavity to the first internal cavity via the channel and (ii) remain closed in response to the pressure within the first internal cavity being less than the threshold while air is flowing from the second internal cavity to the first internal cavity via the channel.

3. The refrigerator of claim 1, wherein the pressure relief valve is a one-way valve having a flap, and wherein the flap is configured to (i) transition to a first position to vent air from the first internal cavity to the exterior of the cabinet and (ii) transition to a second position to restrict air from flowing from the first internal cavity to the exterior of the cabinet.

4. The refrigerator of claim 3, wherein the flap is biased toward the second position.

5. The refrigerator of claim 4, wherein a counterweight biases the flap toward the second position.

6. The refrigerator of claim 5, wherein the counterweight is secured to a top of the flap in a cantilevered configuration.

7. The refrigerator of claim 6, wherein the pressure relief valve includes a body, the body defines an orifice, the flap and counterweight are collectively rotatably secured to the body, and the orifice is positioned to receive the counterweight when the flap is in the second position.

8. A refrigerator comprising:

a housing defining (i) a plurality of internal storage chambers and (ii) access openings, wherein each access opening provides access to one of the internal storage chambers;

a plurality of doors, each door (i) disposed over one of the access openings and (ii) configured to transition between open and closed positions to respectively provide access to and cover one of the openings;

an internal wall (i) disposed within the housing, (ii) separating a first of the internal storage chambers from a second of the internal storage chambers, and (iii) defining a channel that establishes fluid communication between the first and second of the internal storage chambers; and a pressure relief valve (i) secured to the housing, (ii) extending between the first of the internal storage chambers and an exterior of the cabinet, (iii) configured to automatically open to vent air from the first of the internal storage chambers to the exterior of the cabinet in response to air flowing from the second of the internal storage chambers to the first of the internal storage chambers via the channel while a first of the doors is in the closed position, and (iv) configured to remain closed in response to air flowing from the second of the internal storage chambers to the first of the internal storage chambers via the channel while the first of the doors is in the open position.

9. The refrigerator of claim 8, wherein the pressure relief valve is configured to open in response to a pressure within the first of the internal storage chambers exceeding a threshold due to air flowing from the second of the internal storage chambers to the first of the internal storage chambers via the channel.

10. The refrigerator of claim 9, wherein the pressure relief valve is configured to remain closed in response to the pressure within the first of the internal storage chambers being less than the threshold while air is flowing from the second of the internal storage chambers to the first of the internal storage chambers via the channel.

11. The refrigerator of claim 8, wherein the pressure relief valve is a one-way valve having a flap, and wherein the flap is configured to (i) transition to a first position to vent air from the first of the internal storage chambers to the exterior of the cabinet and (ii) transition to a second position to restrict air from flowing from the first of the internal storage chambers to the exterior of the cabinet.

12. The refrigerator of claim 11, wherein the flap is biased toward the second position.

13. The refrigerator of claim 12, wherein a counterweight biases the flap toward the second position.

14. The refrigerator of claim 13, wherein the counterweight is secured to a top of the flap in a cantilevered configuration.

15. The refrigerator of claim 14, wherein the pressure relief valve includes a body, the body defines an orifice, the flap and counterweight are collectively rotatably secured to the body, and the orifice is positioned to receive the counterweight when the flap is in the second position.

16. A refrigerator comprising:

a cabinet defining first and second internal storage chambers;

first and second doors (i) disposed over the first and second internal storage chambers, respectively, and (ii) configured to transition between open and closed positions to provide access to and cover the first and second internal storage chambers, respectively;

a partition wall (i) separating the first internal storage chamber from the second internal storage chamber and (ii) defining a channel that establishes fluid communication between the first and second internal storage chambers; and a pressure relief valve (i) extending between the first internal storage chamber and an exterior of the cabinet (ii) configured to open to vent air from the first internal storage chamber to the exterior of the cabinet in response to air flowing from the second internal storage chamber to the first internal storage chamber via the channel as a result of transitioning the second door to the closed position while the first door is in the closed position, and (iii) configured to remain closed in response to air flowing from the second internal storage chamber to the first internal storage chamber via the channel as a result of transitioning the second door to the closed position while the first door is in the open position.

17. The refrigerator of claim 16, wherein the pressure relief valve is configured to (i) open in response to a pressure within the first internal storage chamber exceeding a threshold due to air flowing from the second internal storage chamber to the first internal storage chamber via the and (ii) remain closed in response to the pressure within the first internal storage chamber being less than the threshold while air is flowing from the second internal storage chamber to the first internal storage chamber via the channel.

18. The refrigerator of claim 16, wherein the pressure relief valve is a one-way valve having a valve plate, and wherein the valve plate is configured to (i) transition to a first position to vent air from the first internal storage chamber to the exterior of the cabinet and (ii) transition to a second position to restrict air from flowing from the first internal storage chamber to the exterior of the cabinet.

19. The refrigerator of claim 18, wherein a counterweight biases the valve plate toward the second position, and wherein the counterweight is secured to a top of the valve plate in a cantilevered configuration.

20. The refrigerator of claim 19, wherein the pressure relief valve includes a body, the body defines an orifice, the valve plate and counterweight are collectively rotatably secured to the body, and the orifice is positioned to receive the counterweight when the valve plate is in the second position.

* * * * *